US008800498B2

(12) United States Patent
Abughazaleh

(10) Patent No.: US 8,800,498 B2
(45) Date of Patent: Aug. 12, 2014

(54) SYSTEMS AND METHODS FOR EXCHANGING HEAT IN A GASIFICATION SYSTEM

(75) Inventor: John Abughazaleh, Sugar Land, TX (US)

(73) Assignee: Kellogg Brown & Root LLC, Houston, TX (US)

( * ) Notice: Subject to any disclaimer, the term of this patent is extended or adjusted under 35 U.S.C. 154(b) by 727 days.

(21) Appl. No.: 12/982,194

(22) Filed: Dec. 30, 2010

(65) Prior Publication Data

US 2012/0168127 A1 Jul. 5, 2012

(51) Int. Cl.

| | |
|---|---|
| ***C10J 3/54*** | (2006.01) |
| ***C10K 1/02*** | (2006.01) |
| ***C10K 1/06*** | (2006.01) |
| ***F22B 1/18*** | (2006.01) |
| ***C10J 3/86*** | (2006.01) |
| *F28D 21/00* | (2006.01) |

(52) U.S. Cl.

CPC ..... *C10K 1/02* (2013.01); *C01J 2300/1675* (2013.01); *C10J 2300/1892* (2013.01); *F28D 2021/0045* (2013.01); *C10J 2300/1823* (2013.01); *C10J 2300/1678* (2013.01); *C10K 1/06* (2013.01); *C10J 2300/1884* (2013.01); *F28D 2021/0075* (2013.01); *F22B 1/18* (2013.01); *C10J 3/86* (2013.01); *F28D 21/0001* (2013.01)

USPC ..... 122/7 R; 48/197 R; 165/104.16

(58) Field of Classification Search

USPC ..... 122/7 R, 31.1; 48/197 R, 210; 165/104.16, 134.1, 135, 142

See application file for complete search history.

(56) References Cited

U.S. PATENT DOCUMENTS

| | | | | |
|---|---|---|---|---|
| 2,287,600 | A | 6/1942 | Burkhardt | |
| 4,045,970 | A * | 9/1977 | Tippmer | 62/95 |
| 5,320,168 | A | 6/1994 | Haight | |
| 5,425,792 | A * | 6/1995 | Bishop et al. | 48/197 R |
| 6,435,139 | B1 * | 8/2002 | Brucher | 122/7 R |
| 7,955,403 | B2 * | 6/2011 | Ariyapadi et al. | 48/197 R |
| 8,328,889 | B2 * | 12/2012 | Agrawal | 48/210 |
| 8,382,867 | B2 * | 2/2013 | Ariyapadi et al. | 48/197 R |
| 8,475,587 | B2 * | 7/2013 | Obrist et al. | 106/739 |
| 2009/0151902 | A1 | 6/2009 | Jacobs et al. | |
| 2010/0011664 | A1 | 1/2010 | Ariyapadi et al. | |

* cited by examiner

*Primary Examiner* — Gregory A Wilson

(74) *Attorney, Agent, or Firm* — Gary M. Machetta

(57) ABSTRACT

Systems and methods for exchanging heat in a gasification system are provided. The method can include introducing one or more particulates and a heat transfer medium including a feed water, a deaerated feed water, or a combination thereof, to a first zone. The method can also include indirectly exchanging heat from the one or more particulates to the heat transfer medium within the first zone to provide an intermediate heat transfer medium and cooled particulates. The method can also include introducing at least a portion of the intermediate heat transfer medium and a syngas to a second zone. The method can also include indirectly exchanging heat from the syngas to the intermediate heat transfer medium within the second zone to provide a heat transfer medium product and a cooled syngas. The heat transfer medium product can include steam.

20 Claims, 2 Drawing Sheets

SYSTEMS AND METHODS FOR EXCHANGING HEAT IN A GASIFICATION SYSTEM

BACKGROUND

1. Field

Embodiments described herein generally relate to the gasification of hydrocarbons. More particularly, such embodiments relate to systems and methods for recovering heat from a syngas and generating steam therefrom.

2. Description of the Related Art

Gasification is a high-temperature process usually conducted at elevated pressure that converts carbon-containing material into mostly gaseous mixtures, including carbon dioxide, carbon monoxide, hydrogen, and methane. These gaseous mixtures are typically referred to as synthesis gas or, more succinctly, syngas. Upon production, syngas can be used as a feedstock to generate electricity and/or steam, a source of hydrogen, and for the production of other organic chemicals. Thus, gasification adds value to low-value feedstocks by converting them to marketable products. Coal, crude oil, coke, and high-sulfur residues have been used as gasification feedstock. The gasification feedstock is typically reacted in a gasifier (i.e. reactor) with an oxidizing medium in a reduced (stoichiometrically oxygen-starved) atmosphere at a high temperature and (usually) high pressure.

In certain gasification systems, the production of syngas provides particulate-containing fluids that are cooled, for example, by heat exchange with a heat transfer medium. Conditions of the particulate-containing fluids being cooled generally result in modest amounts of heat being recovered at relatively low temperatures. Generally, the heat is recovered for providing, for example, low pressure steam having a pressure ranging from about 1,379 kilopascals (kPa) to about 1,724 kPa. The heat recovered from particulate-containing fluids being cooled is generally considered to be of low quality within the gasification system and systems and methods to improve the use of such heat would be advantageous.

There is a need, therefore, for improved systems and methods for recovering heat from syngas and generating steam therefrom.

DETAILED DESCRIPTION

Systems and methods for exchanging heat in a gasification system are provided. The method can include introducing one or more particulates and a heat transfer medium including a feed water, a deaerated feed water, or a combination thereof, to a first zone. The method can also include indirectly exchanging heat from the one or more particulates to the heat transfer medium within the first zone to provide an intermediate heat transfer medium and cooled particulates. The method can also include introducing at least a portion of the intermediate heat transfer medium and a syngas to a second zone. The method can also include indirectly exchanging heat from the syngas to the intermediate heat transfer medium within the second zone to provide a heat transfer medium product and a cooled syngas. The heat transfer medium product can include steam.

Figure 1:
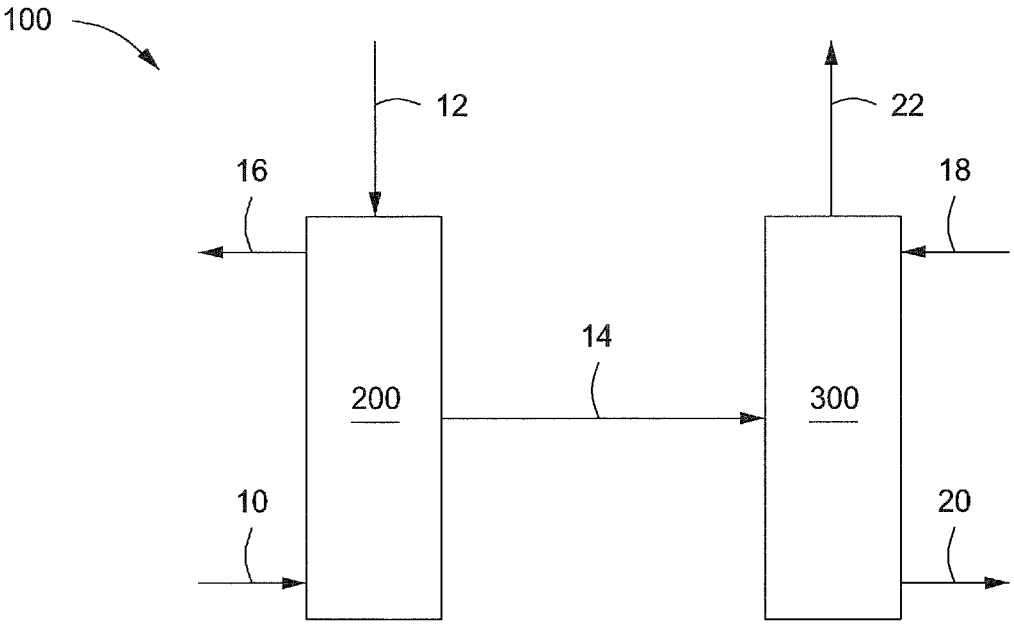
FIG. 1 depicts an illustrative system for recovering heat from syngas and producing steam therefrom, according to one or more embodiments described.

FIG. 1 depicts an illustrative system 100 for recovering heat from a syngas in line 18 and producing steam via line 20 therefrom, according to one or more embodiments. The system 100 can include one or more first zones or first heat exchangers (only one is shown 200) and one or more second zones or second heat exchangers (only one is shown 300) for producing a cooled syngas via line 22. One or more heat transfer mediums via line 10 and one or more particulates via line 12 can be introduced to the first heat exchanger 200 and heat can be indirectly exchanged from the particulates to the heat transfer medium to produce a first heated or "intermediate" heat transfer medium via line 14 and cooled particulates via line 16.

The heat transfer medium can be or include any suitable liquid, gas, or combination thereof, capable of cooling the particulates via indirect heat exchange. Illustrative heat transfer mediums can include, but are not limited to, boiler feed water, deaerated boiler feed water, or a combination thereof.

As used herein, the term "deaerated" refers to a fluid in which at least a portion of any dissolved oxygen and/or other gases has been removed therefrom. Generally, a deaerated fluid can have a level of dissolved oxygen of less than about 5 parts per million (ppm), or less than about 1 ppm, or less than about 0.5 ppm, or less than about 0.2 ppm, or less than about 0.1 ppm, or less than about 0.05 ppm. For example, a deaerated fluid can have a level of dissolved oxygen ranging from about 0.001 ppm to about 1 ppm, or from about 0.01 ppm to about 0.5 ppm, or from about 0.02 ppm to about 0.2 ppm. Fluids can be dearerated by, for example, passing the fluid such as feedwater through a deaerator.

The heat transfer medium in line 10 can be at a temperature ranging from a low of about 25° C., about 50° C., or about 75° C. to a high of about 100° C., about 125° C., or about 150° C. For example, the heat transfer medium in line 10 can be at a temperature of from about 50° C. to about 140° C., about 75° C. to about 130° C., or about 100° C. to about 120° C. The heat transfer medium in line 10 can be at a pressure ranging from a low of about 300 kPa, about 400 kPa, or about 500 kPa to a high of about 4,000 kPa, about 5,000 kPa, or about 6,000 kPa. For example, the heat transfer medium in line 10 can be at a pressure of from about 4,000 kPa to about 6,000 kPa, about 4,250 kPa to about 5,750 kPa, or about 4,500 kPa to about 5,500 kPa.

The particulates in line 12 can be or include any particulate, or combinations of particulates, capable of heating the heat transfer medium via indirect heat exchange to produce the first heated or intermediate heat transfer medium via line 14. The particulates can be produced and/or introduced or otherwise present within any one or more hydrocarbon processing systems. For example, a syngas production process can produce and/or use particulates capable of heating the heat transfer medium via indirect heat exchange to produce the intermediate heat transfer medium via line 14. Illustrative hydrocarbon processing systems can include, but are not limited to, the gasification of hydrocarbons, cracking of hydrocarbons, or a combination thereof. For example, the particulates can be produced within one or more gasifiers (not shown) during the production of syngas. The gasifier can be or include any type of gasifier, for example, a fixed bed gasifier, an entrained flow gasifier, and a fluidized bed gasifier. In at least one example, the gasifier can be a fluidized bed gasifier. In another example, the particulates can be or include catalyst particles, such as catalyst particles used within a fluidized catalytic cracking or "FCC" system.

Illustrative particulates can include, but are not limited to, coarse ash particles, fine ash particles, sand, ceramic particles, catalyst particles, or any combination thereof. As used herein, the terms "coarse ash" and "coarse ash particles" are used interchangeably and refer to particulates produced within a gasifier and having an average particle size ranging from a low of about 35 micrometers (μm), about 45 μm, about 50 μm, about 75 μm or about 100 μm to a high of about 450 μm, about 500 μm, about 550 μm, about 600 μm, or about 640 μm. For example, coarse ash particulates can have an average particle size of from about 50 μm to about 350 μm, about 65 μm to about 250 μm, about 40 μm to about 200 μm, or about 85 μm to about 130 μm. As used herein, the terms "fine ash" and "fine ash particles" are used interchangeably and refer to particulates produced within a gasifier and having an average particle size ranging from a low of about 2 μm, about 5 μm, or about 10 μm to a high of about 75 μm, about 85 μm, or about 95 μm. For example, fine ash particulates can have an average particle size of from about 5 μm to about 30 μm, about 7 μm to about 25 μm, or about 10 μm to about 20 μm.

In one or more embodiments, the particulates in line 12 can be mixed, fluidized, or otherwise combined with one or more fluids. In other words, the particulates via line 12 can be a particulate/fluid mixture. Illustrative fluids that can be combined with the particulates in line 12 can include, but are not limited to, syngas, recycled syngas, nitrogen, carbon dioxide, carbon monoxide, argon, or any combination thereof. For example, coarse ash can be recovered from a gasifier or downstream of the gasifier as a coarse ash/fluid mixture of coarse ash particles and syngas. In another example, fine ash can be recovered from a gasifier or downstream of the gasifier or downstream of the gasifier as a fine ash/fluid mixture of fine ash particles and syngas. In another example, the coarse ash and/or the fine ash can be recovered from the gasifier or downstream of the gasifier as essentially fluid free particulates, i.e., less than about 3 wt % fluids, and one or more fluids can be added thereto to produce a coarse ash/fluid mixture and/or a fine ash/fluid mixture. As such, the particulates in line 12 can be essentially solid particles or can be mixed, fluidized, or otherwise combined with one or more fluids in any desired ratio. For example, the particulates in line 12 can have a particulate composition ranging anywhere from about 1 wt % to about 100 wt % particulates.

The particulates in line 12 can be at a temperature ranging from a low of about 250° C., about 400° C., or about 500° C. to a high of about 850° C., about 1,000° C., or about 1,100° C. For example, the particulates in line 12 can be at a temperature of from about 280° C. to about 450° C., about 290° C. to about 400° C., or about 300° C. to about 350° C. The particulates in line 12, when mixed with one or more fluids, can be at a pressure ranging from a low of about 300 kPa, about 700 kPa, or about 1,000 kPa to a high of about 4,000 kPa, about 4,500 kPa, or about 5,000 kPa. For example, the particulates in line 12 can be at a pressure of from about 2,000 kPa to about 4,500 kPa, about 2,500 kPa to about 4,250 kPa, about 3,000 kPa to about 4,000 kPa, or about 3,600 kPa to about 4,000 kPa.

The first heated or intermediate heat transfer medium in line 14 can be at a temperature ranging from a low of about 100° C., about 110° C., or about 120° C. to a high of about 140° C., about 150° C., or about 160° C. For example, the intermediate heat transfer medium in line 14 can be at a temperature of from about 100° C. to about 160° C., or about 105° C. to about 150° C., or about 110° C. to about 130° C. The intermediate heat transfer medium in line 14 can be at a pressure ranging from a low of about 300 kPa, about 1,000 kPa, about 2,000 kPa, or about 3,000 kPa to a high of about 3,500 kPa, about 4,000 kPa, about 4,500 kPa, or about 5,000 kPa. For example, the intermediate heat transfer medium in line 14 can be at a pressure of from about 3,000 kPa to about 5,500 kPa, about 4,000 kPa to about 4,900 kPa, or about 4,200 kPa to about 4,700 kPa.

The cooled particulates in line 16 can be at a temperature ranging from a low of about 150° C., about 175° C., or about 200° C. to a high of about 230° C., about 240° C., or about 250° C. For example, the cooled particulates in line 16 can be at a temperature of from about 160° C. to about 220° C., about 170° C. to about 210° C., or about 180° C. to about 200° C. The cooled particulates in line 16 can be at a pressure ranging from a low of about 300 kPa, about 1,000 kPa, or about 1,500 kPa to a high of about 3,000 kPa, about 3,500, or about 4,000 kPa. For example, the cooled particulates in line 16 can be at pressure of from about 3,500 kPa to about 4,000 kPa, about 3,550 kPa to about 3,850, or about 3,700 kPa to about 3,800 kPa.

The first heated or intermediate heat transfer medium via line 14 and a syngas via line 18 can be introduced to the second zone or second heat exchanger 300. Heat can be indirectly exchanged from the syngas to the intermediate heat transfer medium within the second heat exchanger 300 to produce a second heated heat transfer medium or heat transfer medium product via line 20 and a cooled syngas via line 22. The heat exchanged from the syngas to the intermediate heat transfer medium within the second heat exchanger 300 can be indirectly exchanged. When the heat transfer medium includes water, the heat transfer medium via line 20 can be or include steam. For example, when the heat transfer medium in line 10 includes boiler feed water and/or deaerated boiler feed water, the heat transfer medium product via line 20 can be high pressure steam, high pressure superheated steam, or a combination thereof.

The syngas in line 18 can be at a temperature ranging from a low of about 750° C., about 800° C., about 850° C., about 875° C., about 900° C., or about 915° C. to a high of about 1,050° C., about 1,075° C., about 1,100° C., about 1,150° C., about 1,200° C., or about 1,250° C. For example, the syngas in line 18 can be at a temperature of from about 925° C. to about 1,090° C., about 950° C. to about 1,050° C., about 1,000° C. to about 1,115° C., or about 900° C. to about 1,125° C. The syngas in line 18 can be at a pressure ranging from a low of about 300 kPa, about 1,000 kPa, or about 1,500 kPa to a high of about 4,000 kPa, about 4,500 kPa, or about 5,000 kPa. For example, the syngas in line 18 can be at a pressure of from about 3,500 kPa to about 4,500 kPa, about 3,700 kPa to about 4,300 kPa, or about 3,800 kPa to about 4,200 kPa.

The second heated heat transfer medium or heat transfer medium product via line 20 can be at a temperature ranging from a low of about 300° C., about 325° C., about 350° C., about 370° C., about 390° C., about 415° C., about 425° C., or about 435° C. to a high of about 440° C., about 445° C., about 450° C., about 455° C., about 460° C., about 470° C., about 500° C., about 550° C., about 600° C., or about 650° C. For example, the heat transfer medium product in line 20 can be at a temperature of from about 427° C. to about 454° C., about 415° C. to about 433° C., about 430° C. to about 460° C., or about 420° C. to about 455° C. The heat transfer medium product in line 20 can be at a pressure ranging from a low of about 3,000 kPa, about 3,500 kPa, about 4,000 kPa, or about 4,300 kPa to a high of about 4,700 kPa, about 5,000 kPa, about 5,300 kPa, about 5,500 kPa, about 6,000 kPa, or about 6,500 kPa. For example, the heat transfer medium product in line 20 can be at a pressure of from about 3,550 kPa to about 5,620 kPa, about 3,100 kPa to about 4,400 kPa, about 4,300 kPa to about 5,700 kPa, or about 3,700 kPa to about 5,200 kPa.

The cooled syngas via line 22 can be at a temperature ranging from a low of about 200° C., about 250° C., about 275° C., or about 300° C. to a high of about 315° C., about 330° C., about 350° C., about 400° C., about 500° C., about 550° C., or about 600° C. For example, the cooled syngas in line 22 can be at a temperature of from about 290° C. to about 330° C., about 305° C. to about 320° C., about 260° C. to about 430° C., or about 260° C. to about 340° C. The cooled syngas in line 22 can be at a pressure ranging from a low of about 300 kPa, about 1,000 kPa, or about 1,500 kPa to a high of about 3,000 kPa, about 4,000 kPa, or about 5,000 kPa. For example, the cooled syngas in line 22 can be at a pressure of from about 3,500 kPa to about 4,500 kPa, about 3,600 kPa to about 4,300 kPa, or about 3,800 kPa to about 4,200 kPa.

When the heat transfer medium in line 10 includes primarily or essentially water, the pressures of the heat transfer medium via line 10, the first heated or intermediate heat transfer medium via line 14, and the second heated heat transfer medium or heat transfer medium product via line 20, as discussed and described herein, can be referred to as "high pressure." As used herein, the term "essentially water" refers to a heat transfer medium that includes at least 90 wt % water. For example, essentially water can be about 95 wt % water, about 96 wt % water, about 97 wt % water, about 98 wt % water, about 99 wt % water, about 99.5 wt % water, or about 99.9 wt % water or more. The heat transfer medium in line 10, in addition to water can include one or more impurities, additives, treatment aids, and the like. For example, the heat transfer medium in line 10 can include one or more corrosion inhibitors. In another example, the heat transfer medium in line 10 can include one or more acids and/or bases for adjusting a pH of the heat transfer medium.

The syngas in lines 18 and 22 can contain about 85 vol % or more carbon monoxide and hydrogen with the balance being primarily carbon dioxide and methane. In another example, the syngas in lines 18 and 22 can contain about 90 vol % or more carbon monoxide and hydrogen, about 95 vol % or more carbon monoxide and hydrogen, about 97 vol % or more carbon monoxide and hydrogen, or about 99 vol % or more carbon monoxide and hydrogen. The carbon monoxide content of syngas in lines 18 and 22 can range from about 10 vol %, 20 vol %, or 30 vol % to about 50 vol %, 70 vol % or 85 vol %. The carbon monoxide content of syngas in lines 18 and 22 can range from about 15 vol %, 25 vol %, or 35 vol % to about 65 vol %, 75 vol % or 85 vol %. The hydrogen content of the syngas in lines 18 and 22 can range from about 1 vol %, 5 vol %, or 10 vol % to about 30 vol %, 40 vol % or 50 vol %. The hydrogen content of syngas in lines 18 and 22 can range from about 20 vol % to about 30 vol %.

The syngas in lines 18 and 22 can contain less than about 25 vol % of combined nitrogen, methane, carbon dioxide, water, hydrogen sulfide, and hydrogen chloride, or can contain less than about 20 vol % of combined nitrogen, methane, carbon dioxide, water, hydrogen sulfide, and hydrogen chloride, or can contain less than about 15 vol % of combined nitrogen, methane, carbon dioxide, water, hydrogen sulfide, and hydrogen chloride, or can contain less than about 10 vol % of combined nitrogen, methane, carbon dioxide, water, hydrogen sulfide, and hydrogen chloride, or can contain less than about 5 vol % of combined nitrogen, methane, carbon dioxide, water, hydrogen sulfide, and hydrogen chloride.

The carbon dioxide content of the syngas in lines 18 and 22 can be about 25 vol % or less, 20 vol % or less, 15 vol % or less, 10 vol % or less, 5 vol % or less, 3 vol % or less, 2 vol % or less, or 1 vol % or less. The methane content of the syngas in lines 18 and 22 can be about 15 vol % or less, 10 vol % or less, 5 vol % or less, 3 vol % or less, 2 vol % or less, or 1 vol % or less. The water content of the syngas in lines 18 and 22 can be about 40 vol % or less, 30 vol % or less, 25 vol % or less, 20 vol % or less, 15 vol % or less, 10 vol % or less, 5 vol % or less, 3 vol % or less, 2 vol % or less, or 1 vol % or less. The syngas in lines 18 and 22 can be nitrogen-free or essentially nitrogen-free, for example, containing less than about 3 vol %, less than about 2 vol %, less than about 1 vol %, or less than about 0.5 vol % nitrogen.

The syngas in lines 18 and 22 can have a heating value, corrected for heat losses and dilution effects, of about 1,863 kJ/m$^3$ (50 Btu/set) to about 2,794 kJ/m$^3$ (75 Btu/scf), about 1,863 kJ/m$^3$ (50 Btu/scf) to about 3,726 kJ/m$^3$ (100 Btu/set), about 1,863 kJ/m$^3$ (50 Btu/scf) to about 4,098 kJ/m$^3$ (110 Btu/scf), about 1,863 kJ/m$^3$ (50 Btu/scf) to about 5,516 kJ/m$^3$ (140 Btu/scf), about 1,863 kJ/m$^3$ (50 Btu/scf) to about 6,707 kJ/m$^3$ (180 Btu/set), about 1,863 kJ/m$^3$ (50 Btu/scf) to about 7,452 kJ/m$^3$ (200 Btu/scf), about 1,863 kJ/m$^3$ (50 Btu/scf) to about 9,315 kJ/m$^3$ (250 Btu/scf), about 1,863 kJ/m$^3$ (50 Btu/scf) to about 10,264 kJ/m$^3$ (275 Btu/scf), about 1,863 kJ/m$^3$ (50 Btu/scf) to about 11,178 kJ/m$^3$ (300 Btu/scf), about 1,863 kJ/m$^3$ (50 Btu/scf) to about 13,041 kJ/m$^3$ (350 Btu/scf), or about 1,863 kJ/m$^3$ (50 Btu/scf) to about 14,904 kJ/m$^3$ (400 Btu/scf).

Still referring to FIG. 1, the process according to one or more embodiments for cooling the particulates in line 12 and the syngas in line 18 can include introducing the heat transfer medium via line 10 including feed water, deaerated feed water, or a combination thereof, to the first heat exchanger 200; introducing the particulates via line 12 to the first heat exchanger 200; indirectly exchanging heat from the particulates to the heat transfer medium within the first heat exchanger 200 to produce the first heated heat transfer medium or intermediate heat transfer medium via line 14, and cooled particulates via line 16. At least a portion of the intermediate heat transfer medium via line 14 and the syngas via line 18 can be introduced to the second heat exchanger 300. Heat can be indirectly exchanged from the syngas to the intermediate heat transfer medium within the second heat exchanger 300 to produce the heat transfer medium product via line 20 and the cooled syngas via line 22.

In one or more embodiments, the system 100 can include any number of first heat exchangers 200 in parallel and/or in series. For example, the system 100 can include one, two, three, four, five, six, seven, eight, nine, ten, or more first heat exchangers 200. In one or more embodiments, the system 100 can include any number of second heat exchangers 300 in parallel and/or in series. For example, the system 100 can include one, two, three, four, five, six, seven, eight, nine, ten, or more second heat exchangers 300.

The one or more first heat exchangers 200 can include any heat exchanger capable of indirectly exchanging heat from the particulates, fluid, or mixture thereof in line 12, to the heat transfer medium in line 10. Illustrative first heat exchangers 200 can include, but are not limited to, one or more shell-and-tube heat exchangers, plate and frame heat exchangers, spiral wound heat exchangers, U-tube heat exchangers, bayonet style heat exchangers, or any combination thereof. In one or more embodiments, the one or more first heat exchangers 200 can include surface enhanced tubes (e.g., fins, static mixers, rifling, heat conductive packing, turbulence causing projections, or any combination thereof), and the like.

The one or more second heat exchangers 300 can include any heat exchanger capable of indirectly exchanging heat from the syngas in line 18 to the intermediate heat transfer medium in line 14. Illustrative second heat exchangers 300 can include, but are not limited to, one or more shell-and-tube heat exchangers, plate and frame heat exchangers, spiral wound heat exchangers, U-tube heat exchangers, bayonet style heat exchangers, or any combination thereof. In one or more embodiments, the one or more second heat exchangers 300 can include surface enhanced tubes (e.g., fins, static mixers, rifling, heat conductive packing, turbulence causing projections, or any combination thereof), and the like.

The pressure of first heat transfer medium via line 10 can reduce or minimize the design complications of the first zone or first heat exchanger 200. For example, when the first heat exchanger 200 includes coils, such as in a shell-and-tube heat exchanger, the heat transfer medium via line 10 can be introduced to the tube side of the shell-and-tube heat exchanger and the high pressure of the heat transfer medium can reduce or prevent vaporizing on the tube side of the coils.

The intermediate heat transfer medium via line 14 can be directly introduced to the second zone or second heat exchanger 300. Introducing the second heat transfer medium via line 14 directly to the second heat exchanger 300 can increase the quantity of heat transfer medium product, for example, high pressure super heated steam produced in the second heat exchanger 300. Increasing the quantity of heat transfer medium product, for example, high pressure super heated steam produced in the second heat exchanger 300 can help increase or improve the thermodynamic efficiency of the system 100 and/or improve the economics of the system 100.

The system 100 can also reduce the need to provide low pressure steam from the first zone or first heat exchanger 200. Reducing the need to provide low pressure steam from the first zone 200 can simplify the design of the coils of the one or more first heat exchangers 200, for example, a fine ash cooler, a coarse ash cooler, or a combination thereof. Reducing the need to provide low pressure steam from first heat exchanger 200 can also reduce the need for equipment associated with producing low pressure steam, for example, reducing the size of or altogether eliminating the need for a low pressure steam drum.

As used herein, the term "indirectly exchanging heat" refers to exchanging heat between two materials, e.g., solids, liquids, gases, or a combination thereof, that are not in direct contact. For example, exchanging heat between two fluids in a shell-and-tube heat exchanger is an example of indirect heat exchange.

Generally, any deaerator known in the art for the removal of dissolved oxygen and other dissolved gases from a fluid can be used to produce a deaerated heat transfer medium via line 10. Illustrative deaerators can include, but are not limited to, tray-type deaerators and/or spray-type deaerators. One or more oxygen-scavenging or other gaseous scavenging chemicals can also be used in lieu of or in addition to one or more deaerators to remove at least a portion of any dissolved oxygen and other gases from the heat transfer medium in line 10, for example, water. Examples of suitable oxygen-scavenging chemicals can include, but are not limited to, sodium sulfite, hydrazine, 1,3-diaminourea, diethylhydroxylamine, nitriloacetic acid, ethylenediaminetetraacetic acid, hydroquinone, or any combination thereof.

In one or more embodiments, although not shown, the heat transfer medium via line 10, particulates via line 12, intermediate heat transfer medium via line 14, and/or syngas via line 18 can be introduced to the appropriate heat exchanger 200, 300 using pumps, compressors, valves, nozzles, and the like. For example, the heat transfer medium via line 10 can be pressurized to a desired pressure using one or more pumps.

Figure 2:
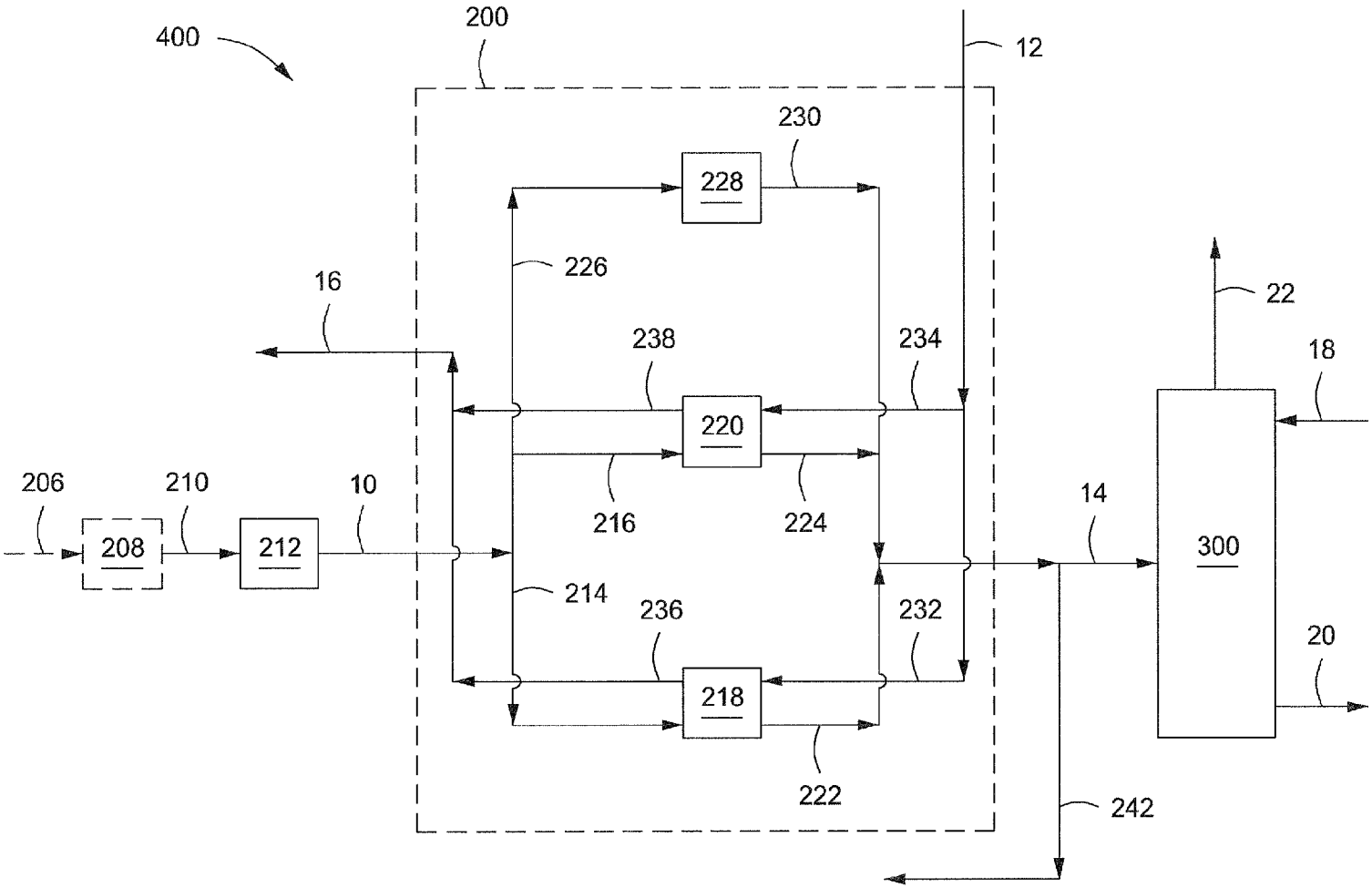
FIG. 2 depicts another illustrative system for recovering heat from syngas and producing steam therefrom, according to one or more embodiments described.

FIG. 2 depicts another illustrative system 400 for recovering heat from a syngas in line 18 and producing steam via line 20 therefrom, according to one or more embodiments. A heat transfer medium via line 210 can be introduced to a means 212 for providing or introducing the heat transfer medium via line 10 to the first zone or first heat exchanger 200. The means 212 can include, but is not limited to, a high pressure pump. When a deaerated first heat transfer medium via line 10 is desired, a heat transfer medium via line 206 can be introduced to one or more deaerators 208 to provide a deaerated heat transfer medium via line 210. In another example, the heat transfer medium in line 10, i.e., after introduction to the means 212, can be introduced to one or more deaerators 208.

In one or more embodiments, the heat transfer medium via line 10 can be divided, split, or otherwise apportioned into two or more portions. For example, the heat transfer medium in line 10 can be apportioned into a first portion via line 214 and a second portion via line 216. In one or more embodiments, the particulates in line 12 can be divided, split, or otherwise apportioned into two or more portions. For example, the particulates in line 12 can be apportioned into a first portion via line 232 and a second portion via line 234. The first portion of the heat transfer medium via line 214 and the first portion of the particulates via line 232 can be introduced to a first particulate cooler 218 and heat can be indirectly exchanged from the first portion of the particulates to the first portion of the heat transfer medium. The second portion of the heat transfer medium via line 216 and the second portion of the particulates via line 234 can be introduced to a second particulate cooler 220 and heat can be indirectly exchanged from the second portion of the particulates to the second portion of the heat transfer medium. A heated first portion and a heated second portion of the heat transfer medium via lines 222 and 224, respectively, can be recovered from the first particulate cooler 218 and the second particulate cooler 220, respectively. A cooled first portion and a cooled second portion of the particulates via line 236 and 238, respectively, can be recovered from the first particulate cooler 218 and the second particulate cooler 220, respectively.

As used herein, the term "particulate cooler" refers to any heat exchanger configured to indirectly exchange heat from one or more particulates to one or more heat transfer mediums. For example, when a shell-and-tube heat exchanger includes one or more particulates or particulate/fluid mixtures flowing therethrough, for example through the shell side of the shell-and-tube heat exchanger, the shell-and-tube heat exchanger can be referred to as a particulate cooler. Additionally, when the one or more particulates include fine ash or coarse ash, the particulate cooler can also be referred to as a fine ash cooler or a coarse ash cooler, respectively.

The heated first and second portions of the heat transfer medium via lines 222 and 224, respectively, can be combined to provide the first heated or intermediate heat transfer medium via line 14. The intermediate heat transfer medium via line 14 can be introduced to the second zone or second heat exchanger 300. While the first heated first portion via line 222 and the first heated second portion via line 224 of the heat transfer medium are depicted as being combined into one intermediate heat transfer medium via line 14, the first portion via line 222 and the second portion via line 224 can be introduced separately to the second zone 300. In another example, the first portion via line 222 or the second portion via line 224 of the heat transfer medium can be introduced to the second heat exchanger 300 with the other not introduced thereto.

In one or more embodiments, the heat transfer medium in line 10 can be divided, split, or otherwise apportioned into three or more portions. For example, as depicted in FIG. 2, the heat transfer medium in line 10 can be apportioned into the first portion via line 214, the second portion via line 216, and a third portion via line 226. The third portion of the heat transfer medium via line 226 can be introduced to a bypass control system 228 to provide a bypass portion via line 230 of the heat transfer medium in line 10. Bypassing a portion of the heat transfer medium in line 10 around the first and second particulate coolers 218, 220 can be used to adjust or control the amount of the heat transfer medium in line 10 introduced to the first and second particulate coolers 218, 220, respectively. Any desired amount of the first heat transfer medium in line 10 can be introduced via line 226 to the bypass control system 228 to provide the bypass portion via line 230. For example, from about 1% to about 90% of the first heat transfer medium in line 10 can be introduced as the third portion via line 226 to the bypass control system 228 to provide the bypass portion via line 230. In another example, the amount of the first heat transfer medium in line 10 that can be introduced as the third portion via line 226 to the bypass control system 228 to provide the bypass portion via line 230 can range from a low of about 20%, about 25%, or about 30% to a high of about 70%, about 75%, or about 80% of the total amount of first heat transfer medium in line 10.

In one or more embodiments, the amount of the first portion of the heat transfer medium in line 214 and the amount of the second portion of the heat transfer medium in line 216 introduced to the first and second particulate coolers 218, 220, respectively, can be the same or different. For example, more of the first heat transfer medium in line 10 can be introduced as the first portion via line 214 to the first particulate cooler 218, as compared to the second portion introduced via line 216 to the second particulate cooler 220. In another example, more of the first heat transfer medium in line 10 can be introduced as the second portion via line 216 to the second particulate cooler 220, as compared to the first portion introduced via line 214 to the first particulate cooler 218.

The ratio of the first portion to the second portion of the first heat transfer medium introduced via lines 214 and 216, respectively, to the first and second particulate coolers 218, 220, respectively, can range from about 1:0.1 to about 0.1:1, about 1:1.2 to about 1.2:1, about 1:1.3 to about 1.3:1, about 1:1.5 to about 1.5:1, about 1:1.7 to about 1.7:1, or about 1:2 to about 2:1. In another example, the ratio of the first portion to the second portion of the first heat transfer medium introduced via lines 214 and 216, respectively, to the first and second particulate coolers 218, 220, respectively, can range from about 1:2 to about 1:10, about 1:1 to about 1:15, about 1:0.5 to about 1:5, or about 1:1 to about 1:20. In another example, the ratio of the first portion to the second portion of the first heat transfer medium introduced via lines 214 and 216, respectively, to the first and second particulate coolers 218, 220, respectively, can range from about 2:1 to about 10:1, about 1:1 to about 15:1, about 0.5:1 to about 5:1, or about 1:1 to about 20:1.

The particulates via line 12 can be introduced to the first zone or first heat exchanger 200 as one or more separate or independent feeds. For example, particulates can be separated within a gasification system (not shown) at one or more locations. In other words, rather than combining particulates separated within a gasification system and transporting the particulates via a single line 12, the particulates can be transported or introduced to the first zone or first heat exchanger 200 independent of one another. For example, fine ash particulates and coarse ash particulates can be recovered from a gasification system at one or more different locations therein. Instead of mixing or combining the separated fine ash and coarse ash with one another, the fine ash and coarse ash can be introduced separately to the first zone 200. For example, the fine ash can be introduced to the second particulate cooler 220 and the coarse ash can be introduced to the first particulate cooler 218 or vice versa. As such, the particulate coolers 218, 220 can be referred to as fine ash coolers and/or coarse ash coolers.

As noted above, the cooled first portion of the particulates via line 236 and the cooled second portion of the particulates via line 238 can be recovered from the first and second particulate coolers 218, 220, respectively. While cooled first portion via line 236 and the cooled second portion via line 238 are depicted as being combined to provide cooled particulates via line 16, the first portion via line 236 and second portion via line 238 can remain separate or independent from one another.

The first heated or intermediate heat transfer medium via line 14 can be introduced to the second zone 300 where heat can be indirectly exchanged therein with the syngas introduced via line 18 to produce the second heated or heat transfer medium product via line 20 and the cooled syngas via line 22. In one or more embodiments, at least a portion of the intermediate heat transfer medium in line 14 can be removed from the system 400 via line 242. Removing at least a portion of the intermediate heat transfer medium via line 242 can be carried out continuously, semi-continuously, or during certain events. For example, during start-up of the system 400 at least a portion of the intermediate heat transfer medium via line 242 can be removed from the system 400 to help control the start-up of the system 400.

An illustrative gasification system (not shown) can include one or more gasifiers, particulate removal systems, first zones or first heat exchangers 200, and second zones or second heat exchangers 300 as disclosed herein. For example, the first zone 200 can be a particulate or fluid/particulate mixture cooling system, and the second zone 300 can be a syngas cooler. The gasification system can also include one or more converters to produce Fischer-Tropsch products, chemicals, and/or feedstocks, including ammonia and methanol. The gasification system can also include one or more hydrogen separators, fuel cells, combustion turbines, steam turbines, waste heat boilers, and generators to produce fuel, power, steam and/or energy. The gasification system can also include an air separation unit ("ASU") for the production of essentially nitrogen-free syngas.

In the gasification system, a feedstock and an oxidant can be introduced to the gasifier to produce syngas. The type and amount of oxidant can determine the composition and physical properties of the syngas and hence, the downstream products made therefrom. Examples of suitable oxidants can include, but are not limited to, air, oxygen, essentially oxygen, oxygen-enriched air, mixtures of oxygen and air, mixtures of oxygen and gas, and mixtures of oxygen and inert gas, for example, nitrogen and argon. The oxidant can contain about 65 vol % oxygen or more, or about 70 vol % oxygen or more, or about 75 vol % oxygen or more, or about 80 vol % oxygen or more, or about 85 vol % oxygen or more, or about 90 vol % oxygen or more, or about 95 vol % oxygen or more, or about 99 vol % oxygen or more. As used herein, the term "essentially oxygen" refers to an oxygen stream containing more than 50 vol % oxygen. As used herein, the term "oxygen-enriched air" refers to air containing about 21 vol % oxygen to about 50 vol % oxygen. Oxygen-enriched air and/or essentially oxygen can be obtained, for example, from cryogenic distillation of air, pressure swing adsorption, membrane separation, or any combination thereof.

The oxidant can be nitrogen-free or essentially nitrogen-free. As used herein, the term "essentially nitrogen-free" refers to an oxidant that contains about 5 vol % nitrogen or less, about 4 vol % nitrogen or less, about 3 vol % nitrogen or less, about 2 vol % nitrogen or less, or about 1 vol % nitrogen or less.

The feedstock introduced to the gasifier can be or include any carbonaceous or carbon containing material, whether solid, gas, liquid, or any combination thereof. Examples of a suitable carbonaceous material include, but are not limited to, biomass (i.e., plant and/or animal matter or plant and/or animal derived matter); coal (high-sodium and low-sodium lignite, lignite, subbituminous, and/or anthracite, for example); oil shale; coke; tar; asphaltenes; low ash or no ash polymers; hydrocarbon-based polymeric materials; biomass derived material; or by-product derived from manufacturing operations. Examples of suitable hydrocarbon-based polymeric material include, but are not limited to, thermoplastics, elastomers, rubbers, including polypropylenes, polyethylenes, polystyrenes, including other polyolefins, homo polymers, copolymers, block copolymers, and blends thereof; PET (polyethylene terephthalate), poly blends, poly-hydrocarbons containing oxygen; heavy hydrocarbon sludge and bottoms products from petroleum refineries and petrochemical plants such as hydrocarbon waxes; blends thereof, derivatives thereof; and combinations thereof.

The feedstock can include a mixture or combination of two or more carbonaceous materials (i.e., carbon-containing materials). The feedstock can include a mixture or combination of two or more low ash or no ash polymers, biomass derived materials, or by-products derived from manufacturing operations. The feedstock can include a carbonaceous material combined with a discarded consumer product, for example, carpet and/or plastic automotive parts/components including bumpers and dashboards. Such discarded consumer products are preferably suitably reduced in size to fit within a gasifier. The feedstock can include a recycled plastic, for example, polypropylene, polyethylene, polystyrene, derivatives thereof, blends thereof, or any combination thereof. Accordingly, the systems and methods disclosed herein can be useful for accommodating mandates for proper disposal of previously manufactured materials.

One or more particulate removal systems can be used to partially or completely remove any particulates from the syngas to provide the particulates or particulate-containing fluid via line 12 and a separated syngas via line 18. The syngas can be cooled in the second zone 300 as disclosed herein. For example, the syngas can be cooled to about 538° C. or less, about 482° C. or less, about 427° C. or less, about 371° C. or less, about 316° C. or less, about 260° C. or less, about 204° C. or less, or about 149° C. or less. The one or more second zones 300 can be utilized, for example, as a primary syngas cooler and another second zone 300 can be utilized as a secondary syngas cooler. For example, the syngas can be cooled in a first second zone 300 utilized as a primary cooler to obtain a first cooled syngas and then the first cooled syngas can be cooled in another second zone 300 utilized as a secondary cooler to obtain a second cooled syngas having a temperature less than the first cooled syngas. In another example, the syngas recovered from the gasifier can be split into two or more portions and the two or more portions can be introduced to two or more second zones 300 in parallel, for example.

The particulate removal system can include a separation device for example conventional disengagers and/or cyclones. Particulate control devices ("PCD") capable of providing an outlet particulate concentration below the detectable limit of about 0.1 parts per million by weight (ppmw) can also be used. Examples of suitable PCDs can include, but are not limited to, sintered metal filters, metal filter candles, and ceramic filter candles (for example, iron aluminide filter material).

The particulates, for example, fine ash, coarse ash, and combinations thereof, can be recycled to the gasifier, purged from the system, utilized as the particulates via line 12 as disclosed herein, or any combination thereof. The syngas can be treated within a gas purification system to remove contaminants. The gas purification system can include a system, a process, or a device to remove sulfur and/or sulfur-containing compounds from the syngas. Examples of a suitable catalytic gas purification system include, but are not limited to, systems using zinc titanate, zinc ferrite, tin oxide, zinc oxide, iron oxide, copper oxide, cerium oxide, or mixtures thereof. Examples of a suitable process-based gas purification system include, but are not limited to, the SELEXOL® process, the RECTISOL® process, the CRYSTASULF® process, and the Sulfinol gas treatment process.

One or more amine solvents such as methyl-diethanolamine (MDEA) can be used to remove acid gas from the syngas. Physical solvents, for example SELEXOL® (dimethyl ethers of polyethylene glycol) or RECTISOL® (cold methanol), can also be used. If the syngas contains carbonyl sulfide (COS), the carbonyl sulfide can be converted by hydrolysis to hydrogen sulfide by reaction with water over a catalyst and then absorbed using the methods described above. If the syngas contains mercury, the mercury can be removed using a bed of sulfur-impregnated activated carbon.

One or more catalysts, such as a cobalt-molybdenum ("Co—Mo") catalyst can be incorporated into the gas purification system to perform a sour shift conversion of the syngas. The Co—Mo catalyst can operate at a temperature of about 288° C. in the presence of $H_2S$, for example, about 100 parts per million by weight (ppmw) $H_2S$. If a Co—Mo catalyst is used to perform a sour shift, subsequent downstream removal of sulfur can be accomplished using any of the above described sulfur removal methods and/or techniques.

The syngas from the gas purification system can be combusted to produce or generate power and/or steam. The syngas can be sold as a commodity. The syngas can be used to produce Fischer-Tropsch products, chemicals, and/or feedstocks. Hydrogen can be separated from the syngas and used in hydrogenation processes, fuel cell energy processes, ammonia production, and/or as a fuel. Carbon monoxide can be separated from the syngas and used for the production of chemicals, for example, acetic acid, phosgene/isocyanates, formic acid, and propionic acid.

One or more gas converters can be used to convert the syngas into one or more Fischer-Tropsch products, chemicals, and/or feedstocks. The gas converter can include a shift reactor to adjust the hydrogen to carbon monoxide ratio ($H_2$:CO) of the syngas by converting CO to $CO_2$. Within the shift reactor, a water-gas shift reaction reacts at least a portion of the carbon monoxide in the syngas with water in the presence of a catalyst and a high temperature to produce hydrogen and carbon dioxide. Examples of a suitable shift reactor can include, but are not limited to, single stage adiabatic fixed bed reactors, multiple-stage adiabatic fixed bed reactors with interstage cooling, steam generation or cold quench reactors, tubular fixed bed reactors with steam generation or cooling, fluidized bed reactors, or any combination thereof. A sorption enhanced water-gas shift (SEWGS) process, utilizing a pressure swing adsorption unit having multiple fixed bed reactors packed with shift catalyst and at high temperature, e.g. a carbon dioxide adsorbent at about 480° C., can be used. Various shift catalysts can be employed.

The shift reactor can include two reactors arranged in series. A first reactor can be operated at high temperature (about 340° C. to about 400° C.) to convert a majority of the CO present in the syngas to $CO_2$ at a relatively high reaction rate using an iron-chrome catalyst. A second reactor can be operated at a relatively low temperature (about 145° C. to about 205° C.) to complete the conversion of CO to $CO_2$ using a mixture of copper oxide and zinc oxide.

The recovered carbon dioxide from the shift reactor can be used in a fuel recovery process to enhance the recovery of oil and gas. In an illustrative oil recovery process, carbon dioxide can be injected and flushed into an area beneath an existing well where "stranded" oil exists. The water and carbon dioxide removed with the crude oil can then be separated and recycled.

The gas converter can be used to produce one or more Fischer-Tropsch ("F-T") products, including refinery/petrochemical feedstocks, transportation fuels, synthetic crude oil, liquid fuels, lubricants, alpha olefins, and waxes. The reaction can be carried out in any type reactor, for example, fixed bed, moving bed, fluidized bed, slurry, or bubbling bed using copper, ruthenium, iron or cobalt based catalysts, or combination thereof, under conditions ranging from about 190° C. to about 450° C. depending on the reactor configuration.

The F-T products are liquids which can be shipped to a refinery site for further chemically reacting and upgrading to a variety of products. Certain products, for example C4-C5 hydrocarbons, can be high quality paraffin solvents which, if desired, can be hydrotreated to remove olefin impurities, or employed without hydrotreating to produce a wide variety of wax products. C16+ liquid hydrocarbon products can be upgraded by various hydroconversion reactions, for example, hydrocracking, hydroisomerization catalytic dewaxing, isodewaxing, or combinations thereof, to produce mid-distillates, diesel and jet fuels for example low freeze point jet fuel and high cetane jet fuel, isoparaffinic solvents, lubricants, for example, lube oil blending components and lube oil base stocks suitable for transportation vehicles, non-toxic drilling oils suitable for use in drilling muds, technical and medicinal grade white oil, chemical raw materials, and various specialty products.

The gas converter can include a slurry bubble column reactor to produce an F-T product. The slurry bubble column reactor can operate at a temperature of less than about 220° C. and from about 69 kPa to about 4,137 kPa, or about 1,724 kPa to about 2,413 kPa using a cobalt catalyst promoted with rhenium and supported on titania having a Re:Co weight ratio in a range of about 0.01 to about 1 and containing from about 2% wt to about 50% wt cobalt. The catalyst within the slurry bubble column reactor can include, but is not limited to, a titania support impregnated with a salt of a catalytic copper or an Iron Group metal, a polyol or polyhydric alcohol and, optionally, a rhenium compound or salt. Examples of suitable polyols or polyhydric alcohols include, but are not limited to, glycol, glycerol, derythritol, threitol, ribitol, arabinitol, xylitol, allitol, dulcitol, gluciotol, sorbitol, and mannitol. The catalytic metal, copper or Iron Group metal as a concentrated aqueous salt solution, for example cobalt nitrate or cobalt acetate, can be combined with the polyol and optionally perrhenic acid while adjusting the amount of water to obtain 15 wt % metal, for example, 15 wt % cobalt, in the solution and using optionally incipient wetness techniques to impregnate the catalyst onto rutile or anatase titania support, optionally spray-dried and calcined. This method reduces the need for rhenium promoter.

The gas converter can be used to produce methanol, alkyl formates, dimethyl ether, ammonia, acetic anhydride, acetic acid, methyl acetate, acetate esters, vinyl acetate and polymers, ketenes, formaldehyde, dimethyl ether, olefins, derivatives thereof, and/or combinations thereof. For methanol production, for example, the Liquid Phase Methanol Process can be used (LPMEOHT™). In this process, the carbon monoxide in the syngas can be directly converted into methanol using a slurry bubble column reactor and catalyst in an inert hydrocarbon oil reaction medium which can conserve heat of reaction while idling during off-peak periods for a substantial amount of time while maintaining good catalyst activity. Gas phase processes for producing methanol can also be used. For example, known processes using copper-based catalysts can be used.

For ammonia production, the gas converter can be adapted to operate known processes to produce ammonia. For alkyl formate production, for example, methyl formate, any of several processes wherein carbon monoxide and methanol are reacted in either the liquid or gaseous phase in the presence of an alkaline catalyst or alkali or alkaline earth metal methoxide catalyst can be used.

Carbon dioxide can be separated and/or recovered from the syngas. Physical adsorption techniques can be used. Examples of suitable adsorbents and techniques can include, but are not limited to, propylene carbonate physical adsorbent solvent as well as other alkyl carbonates, dim ethyl ethers of polyethylene glycol of two to twelve glycol units (Selexol™ process), n-methyl-pyrrolidone, sulfolane, and use of the Sulfinol® Gas Treatment Process.

At least a portion of the syngas can be sold or upgraded using further downstream processes. At least a portion of the syngas can be directed to a hydrogen separator. At least a portion of the syngas can bypass the gas converter described above and can be fed directly to the hydrogen separator.

The hydrogen separator can include any system or device to selectively separate hydrogen from syngas to provide a purified hydrogen stream and a waste gas stream. The hydrogen separator can provide a carbon dioxide rich fluid and a hydrogen rich fluid. At least a portion of the hydrogen rich fluid can be used as a feed to a fuel cell and at least a portion of the hydrogen rich fluid can be combined with the syngas prior to use as a fuel in a combustor. The hydrogen separator can utilize pressure swing absorption, cryogenic distillation, and/or semi-permeable membranes. Examples of suitable absorbents include, but are not limited to, caustic soda, potassium carbonate or other inorganic bases, and/or alanolamines.

At least a portion of the syngas can be combusted in a combustor to provide a high pressure/high temperature exhaust gas stream. The high pressure/high temperature exhaust gas stream can be introduced to a combustion turbine to provide an exhaust gas stream and mechanical shaft power to drive an electric generator. The exhaust gas stream can be introduced to a heat recovery system to provide steam. A first portion of the steam can be introduced to a steam turbine to provide mechanical shaft power to drive an electric generator. A second portion of the steam can be introduced to the gasifier, and/or other auxiliary process equipment. Lower pressure steam from the steam turbine can be recycled to the heat recovery system.

Oxygen enriched air or essentially oxygen from one or more air separation units ("ASU") can be supplied to the gasifier. The ASU can provide a nitrogen-lean and oxygen-rich stream to the gasifier, thereby minimizing the nitrogen concentration in the system. The use of a nearly pure oxygen stream allows the gasifier to produce a syngas that is essentially nitrogen-free, for example, containing less than 0.5% nitrogen/argon. The ASU can be a high-pressure, cryogenic type separator that can be supplemented with air. A reject nitrogen stream from the ASU can be added to a combustion turbine or used as utility. For example, up to about 50 vol %, or up to about 40 vol %, or up to about 30 vol %, or up to about 20 vol %, or up to about 10 vol % of the total oxidant fed to the gasifier can be supplied by the ASU.

Embodiments of the present disclosure further relate to any one or more of the following paragraphs:

1. A method for cooling a syngas, comprising: introducing one or more particulates and a heat transfer medium comprising a feed water, a deaerated feed water, or a combination thereof, to a first zone; indirectly exchanging heat from the one or more particulates to the heat transfer medium within the first zone to provide an intermediate heat transfer medium and cooled particulates; introducing at least a portion of the intermediate heat transfer medium and a syngas to a second zone; and indirectly exchanging heat from the syngas to the intermediate heat transfer medium within the second zone to provide a heat transfer medium product and a cooled syngas, wherein the heat transfer medium product comprises steam.

2. The method of paragraph 1, wherein the heat transfer medium is deaerated feed water.

3. The method of paragraph 1 or 2, wherein the one or more particulates comprise coarse ash particles, fine ash particles, sand, ceramic particles, catalyst particles, or any combination thereof.

4. The method according to any one of paragraphs 1 to 3, wherein the one or more particulates comprise coarse ash particles, fine ash particles, or a combination thereof.

5. The method according to any one of paragraphs 1 to 4, wherein the heat transfer medium comprises deaerated feed water at a pressure of about 300 kPa to about 6,000 kPa at a temperature of about 25° C. to about 150° C., wherein the intermediate heat transfer medium is at a pressure of about 300 kPa to about 5,000 kPa and a temperature of about 100° C. to about 160° C., and wherein the heat transfer medium product is at a pressure of about 3,000 kPa to about 6,500 kPa and a temperature of about 350° C. to about 650° C.

6. The method according to any one of paragraphs 1 to 5, wherein the first zone comprises two or more particulate coolers arranged in parallel with respect to one another.

7. The method according to any one of paragraphs 1 to 6; wherein the first zone comprises one or more coarse ash coolers, one or more fine ash coolers, or any combination thereof.

8. The method according to any one of paragraphs 1 to 7, wherein the syngas is at a temperature of about 750° C. to about 1,250° C., and wherein the cooled syngas is at a temperature of about 200° C. to about 600° C.

9. The method according to any one of paragraphs 1 to 8, wherein the first zone comprises at least one coarse ash cooler and at least one fine ash cooler, and wherein the second zone comprises at least one syngas cooler.

10. The method according to any one of paragraphs 1 to 9, wherein the intermediate heat transfer medium is at a temperature of about 100° C. to about 160° C. and a pressure of about 300 kPa to about 5,000 kPa, and wherein the cooled particulates is at a temperature of about 150° C. to about 250° C. and a pressure of about 300 kPa to about 4,000 kPa.

11. The method according to any one of paragraphs 1 to 10, wherein the syngas is at a temperature of about 750° C. to about 1,250° C. and a pressure of about 300 kPa to about 5,000 kPa, and wherein the heat transfer medium product is at a temperature of about 350° C. to about 650° C. and a pressure of about 3,000 kPa to about 6,500 kPa, and wherein the cooled syngas is at a temperature of about 200° C. to about 600° C. and a pressure of about 300 kPa to about 5,000 kPa.

12. A process for cooling a syngas, comprising: introducing a first portion of a heat transfer medium comprising a feed water, a deaerated feed water, or a combination thereof, to a first particulate cooler within a first zone and a second portion of the heat transfer medium to a second particulate cooler within the first zone; introducing one or more first particulates to the first particulate cooler and one or more second particulates to the second particulate cooler, wherein the first particulates comprise coarse ash particles and the second particulates comprise fine ash particles; indirectly exchanging heat within the first cooler from the one or more first particulates to the first portion of the heat transfer medium to produce a heated first portion of the heat transfer medium; indirectly exchanging heat within the second cooler from the one or more second particulates to the second portion of the heat transfer medium to produce a heated second portion of the heat transfer medium; combining the heated first portion of the heat transfer medium and the heated second portion of the heat transfer medium to produce an intermediate heat transfer medium; introducing the intermediate heat transfer medium and a syngas to a syngas cooler; and indirectly exchanging heat within the syngas cooler to produce a heat transfer medium product comprising high pressure superheated steam at a pressure of about 300 kPa to about 6,500 kPa and a temperature of about 300° C. to about 650° C. and a cooled syngas.

13. The method of paragraph 12, wherein the heat transfer medium comprises deaerated water.

14. The method of paragraph 12 or 13, wherein the heat transfer medium comprises deaerated water at a pressure of about 300 kPa to about 5,000 kPa.

15. The method according to any one of paragraphs 12 to 14, wherein the heated first portion of the heat transfer medium is at a pressure of about 300 kPa to about 5,000 kPa and a temperature of about 100° C. to about 160° C., wherein the heated second portion of the heat transfer medium is at a pressure of about 300 kPa to about 5,000 kPa and a temperature of about 100° C. to about 160° C., and wherein the intermediate heat transfer medium is at a pressure of about 300 kPa to about 5,000 kPa and a temperature of about 100° C. to about 160° C.

16. The method according to any one of paragraphs 12 to 15, wherein an amount of the first portion of the heat transfer medium introduced to the first particulate cooler and an amount of the second portion of the heat transfer medium introduced to the second particulate cooler are controlled with respect to one another to produce the heated first portion of the heat transfer medium and the heated second portion of the heat transfer medium.

17. A system for cooling a syngas, comprising: a first zone comprising one or more particulate coolers for indirectly exchanging heat from one or more particulates to one or more heat transfer mediums to produce one or more cooled particulates and one or more first heated heat transfer mediums, wherein the heat transfer medium comprises feed water, deaerated feed water, or a combination thereof at a pressure of about 300 kPa to about 5,000 kPa; and a second zone comprising one or more syngas coolers for indirectly exchanging heat from a syngas to the one or more first heated heat transfer mediums to produce a cooled syngas and a heat transfer medium product, wherein the heat transfer medium product is at a pressure of about 3,000 kPa to about 6,500 kPa and a temperature of about 300° C. to about 650° C.

18. The system of paragraph 17, further comprising a high pressure pump for pressurizing the heat transfer medium.

19. The system of paragraph 17 or 18, further comprising one or more deaerators for deaerating at least a portion of the heat transfer medium.

20. The system according to any one of paragraphs 17 to 19, wherein the first zone comprises one or more coarse ash coolers and one or more fine ash coolers.

Certain embodiments and features have been described using a set of numerical upper limits and a set of numerical lower limits. It should be appreciated that ranges from any lower limit to any upper limit are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention may be devised without departing from the basic scope thereof, and the scope thereof is determined by the claims that follow.

What is claimed is:

1. A method for cooling a syngas, comprising:

introducing one or more particulates and a heat transfer medium comprising a feed water, a deaerated feed water, or a combination thereof, to a first zone, wherein the first zone comprises two or more particulate coolers arranged in parallel with respect to one another;

indirectly exchanging heat from the one or more particulates to the heat transfer medium within the first zone to provide an intermediate heat transfer medium and cooled particulates;

introducing at least a portion of the intermediate heat transfer medium and a syngas to a second zone; and indirectly exchanging heat from the syngas to the intermediate heat transfer medium within the second zone to provide a heat transfer medium product and a cooled syngas, wherein the heat transfer medium product comprises steam.

2. The method of claim 1, wherein the heat transfer medium is deaerated feed water.

3. The method of claim 1, wherein the one or more particulates comprise coarse ash particles, fine ash particles, sand, ceramic particles, catalyst particles, or any combination thereof.

4. The method of claim 1, wherein the one or more particulates comprise coarse ash particles, fine ash particles, or a combination thereof.

5. The method of claim 1, wherein the two or more particulate coolers are shell and tube heat exchangers.

6. The method of claim 1, wherein the first zone comprises one or more coarse ash coolers, one or more fine ash coolers, or any combination thereof.

7. The method of claim 1, wherein the syngas is at a temperature of about 750° C. to about 1,250° C., and wherein the cooled syngas is at a temperature of about 200° C. to about 600° C.

8. The method of claim 1, wherein the first zone comprises at least one coarse ash cooler and at least one fine ash cooler, and wherein the second zone comprises at least one syngas cooler.

9. A method for cooling a syngas, comprising:

introducing one or more particulates and a heat transfer medium comprising a feed water, a deaerated feed water, or a combination thereof, to a first zone;

indirectly exchanging heat from the one or more particulates to the heat transfer medium within the first zone to provide an intermediate heat transfer medium and cooled particulates;

introducing at least a portion of the intermediate heat transfer medium and a syngas to a second zone; and indirectly exchanging heat from the syngas to the intermediate heat transfer medium within the second zone to provide a heat transfer medium product and a cooled syngas, wherein the heat transfer medium product comprises steam, wherein the heat transfer medium comprises deaerated feed water at a pressure of about 300 kPa to about 6,000 kPa at a temperature of about 25° C. to about 150° C., wherein the intermediate heat transfer medium is at a pressure of about 300 kPa to about 5,000 kPa and a temperature of about 100° C. to about 160° C., and wherein the heat transfer medium product is at a pressure of about 3,000 kPa to about 6,500 kPa and a temperature of about 350° C. to about 650° C.

10. A method for cooling a syngas, comprising:

introducing one or more particulates and a heat transfer medium comprising a feed water, a deaerated feed water, or a combination thereof, to a first zone;

indirectly exchanging heat from the one or more particulates to the heat transfer medium within the first zone to provide an intermediate heat transfer medium and cooled particulates;

introducing at least a portion of the intermediate heat transfer medium and a syngas to a second zone; and indirectly exchanging heat from the syngas to the intermediate heat transfer medium within the second zone to provide a heat transfer medium product and a cooled syngas, wherein the heat transfer medium product comprises steam, wherein the intermediate heat transfer medium is at a temperature of about 100° C. to about 160° C. and a pressure of about 300 kPa to about 5.000 kPa, and wherein the cooled particulates is at a temperature of about 150° C. to about 250° C. and a pressure of about 300 kPa to about 4,000 kPa.

11. A method for cooling a syngas, comprising:

introducing one or more particulates and a heat transfer medium comprising a feed water, a deaerated feed water, or a combination thereof, to a first zone;

indirectly exchanging heat from the one or more particulates to the heat transfer medium within the first zone to provide an intermediate heat transfer medium and cooled particulates;

introducing at least a portion of the intermediate heat transfer medium and a syngas to a second zone; and indirectly exchanging heat from the syngas to the intermediate heat transfer medium within the second zone to provide a heat transfer medium product and a cooled syngas, wherein the heat transfer medium product comprises steam, wherein the syngas is at a temperature of about 750° C. to about 1,250° C. and a pressure of about 300 kPa to about 5,000 kPa, and wherein the heat transfer medium product is at a temperature of about 350° C. to about 650° C. and a pressure of about 3,000 kPa to about 6,500 kPa, and wherein the cooled syngas is at a temperature of about 200° C. to about 600° C. and a pressure of about 300 kPa to about 5,000 kPa.

12. A method for cooling a syngas, comprising:

introducing a first portion of a heat transfer medium comprising a feed water, a deaerated feed water, or a combination thereof, to a first particulate cooler within a first zone and a second portion of the heat transfer medium to a second particulate cooler within the first zone;

introducing one or more first particulates to the first particulate cooler and one or more second particulates to the second particulate cooler, wherein the first particulates comprise coarse ash particles and the second particulates comprise fine ash particles;

indirectly exchanging heat within the first cooler from the one or more first particulates to the first portion of the heat transfer medium to produce a heated first portion of the heat transfer medium;

indirectly exchanging heat within the second cooler from the one or more second particulates to the second portion of the heat transfer medium to produce a heated second portion of the heat transfer medium;

combining the heated first portion of the heat transfer medium and the heated second portion of the heat transfer medium to produce an intermediate heat transfer medium;

introducing the intermediate heat transfer medium and a syngas to a syngas cooler; and indirectly exchanging heat within the syngas cooler to produce a heat transfer medium product comprising high pressure superheated steam at a pressure of about 300 kPa to about 6,500 kPa and a temperature of about 300° C. to about 650° C. and a cooled syngas.

13. The method of claim 12, wherein the heat transfer medium comprises deaerated water.

14. The method of claim 12, wherein the heat transfer medium comprises deaerated water at a pressure of about 300 kPa to about 5,000 kPa.

15. The method of claim 12, wherein the heated first portion of the heat transfer medium is at a pressure of about 300 kPa to about 5,000 kPa and a temperature of about 100° C. to about 160° C., wherein the heated second portion of the heat transfer medium is at a pressure of about 300 kPa to about 5,000 kPa and a temperature of about 100° C. to about 160° C., and wherein the intermediate heat transfer medium is at a pressure of about 300 kPa to about 5,000 kPa and a temperature of about 100° C. to about 160° C.

16. The method of claim 15, wherein an amount of the first portion of the heat transfer medium introduced to the first particulate cooler and an amount of the second portion of the heat transfer medium introduced to the second particulate cooler are controlled with respect to one another to produce the heated first portion of the heat transfer medium and the heated second portion of the heat transfer medium.

17. A system for cooling a syngas, comprising:

a first zone comprising one or more particulate coolers for indirectly exchanging heat from one or more particulates to one or more heat transfer mediums to produce one or more cooled particulates and one or more first heated heat transfer mediums, wherein the heat transfer medium comprises feed water, deaerated feed water, or a combination thereof at a pressure of about 300 kPa to about 5.000 kPa; and a second zone comprising one or more syngas coolers for indirectly exchanging heat from a syngas to the one or more first heated heat transfer mediums to produce a cooled syngas and a heat transfer medium product, wherein the heat transfer medium product is at a pressure of about 3,000 kPa to about 6,500 kPa and a temperature of about 300° C. to about 650° C.

18. The system of claim 17, further comprising a high pressure pump for pressurizing the heat transfer medium.

19. The system of claim 17, further comprising one or more deaerators for deaerating at least a portion of the heat transfer medium.

20. The system of claim 17, wherein the first zone comprises one or more coarse ash coolers and one or more fine ash coolers.

* * * * *